United States Patent [19]

Madden et al.

[11] Patent Number: 5,021,711

[45] Date of Patent: Jun. 4, 1991

[54] QUARTZ LAMP ENVELOPE WITH MOLYBDENUM FOIL HAVING OXIDATION-RESISTANT SURFACE FORMED BY ION IMPLANTATION

[75] Inventors: Sandra L. Madden, Lynnfield; Mark D. Beschle, Beverly; Roy C. Martin, Peabody, all of Mass.

[73] Assignee: GTE Products Corporation, Danvers, Mass.

[21] Appl. No.: 608,592

[22] Filed: Oct. 29, 1990

[51] Int. Cl.[5] ..... H01J 17/18; H01J 61/36; H01J 9/32

[52] U.S. Cl. ..... 313/623; 313/332; 427/126.1; 445/35; 445/58

[58] Field of Search ..... 313/623, 331, 332; 174/50.64; 427/118, 126.1, 249; 445/35, 43, 46, 58

[56] References Cited

U.S. PATENT DOCUMENTS

| | | | |
|---|---|---|---|
| 3,105,867 | 10/1963 | Meijer | 174/50.64 |
| 3,753,026 | 8/1973 | Goorissen | 313/332 X |
| 4,015,165 | 3/1977 | Hardies | 313/318 |
| 4,312,899 | 1/1982 | Lahmann | 427/126.1 |
| 4,756,977 | 7/1988 | Haluska et al. | 427/249 X |

*Primary Examiner*—Sandra L. O'Shea
*Attorney, Agent, or Firm*—Joseph S. Romanow

[57] ABSTRACT

A quartz lamp envelope includes a press seal, at least one molybdenum foil feedthrough extending through the press seal to the lamp interior, and an external electrical lead connected to the molybdenum foil. The molybdenum foil has an oxidation-inhibiting material, such as chromium, aluminum and combinations thereof, embedded in a surface layer thereof by ion implantation. The electrical lead has an oxidation-inhibiting coating, such as silicon carbide, silicon nitride and combinations thereof, formed by plasma-enhanced chemical vapor deposition. Alternatively, the electrical lead can have an oxidation-inhibiting material embedded in a surface layer thereof by ion implantation.

24 Claims, 1 Drawing Sheet

QUARTZ LAMP ENVELOPE WITH MOLYBDENUM FOIL HAVING OXIDATION-RESISTANT SURFACE FORMED BY ION IMPLANTATION

This is a continuation of Ser. No. 287,755, filed on Dec. 21, 1988, now abandoned.

CROSS REFERENCE TO RELATED APPLICATION

This application discloses, but does not claim, subject matter which is claimed in U.S. Ser. No. Ser. No. 07/287,757, now abandoned, filed concurrently herewith and assigned to the assignee of this application.

FIELD OF THE INVENTION

This invention relates to electric lamps that utilize quartz lamp envelopes and, more particularly, to quartz lamp envelopes that utilize molybdenum components which are treated to inhibit oxidation.

BACKGROUND OF THE INVENTION

Quartz is commonly used as a lamp envelope material in metal halide lamps and tungsten halogen incandescent lamps. The quartz envelope defines a sealed lamp interior containing a filament or discharge electrodes and a suitable chemical fill. Electrical energy is supplied to the filament or to the electrodes by means of electrical feedthroughs which pass through the lamp envelope and are hermetically sealed to the quartz. It is critical to lamp operation that the seal remain intact throughout the life of the lamp.

It has been customary in quartz lamp envelopes to utilize a feedthrough configuration including a molybdenum ribbon, or foil, which passes through a press or pinch seal region of the quartz envelope. The molybdenum foil is sufficiently wide to conduct the required lamp current and is extremely thin. Since the molybdenum foil is very thin, its thermal expansion is extremely small. Thus, the probability of seal failure due to differential thermal expansion is small. In a conventional design, the quartz is press sealed to the molybdenum foil, and a molybdenum electrical lead is welded to the external end of the foil.

The molybdenum foil and the molybdenum electrical lead have a tendency to oxidize to form $MoO_2$ and $MoO_3$ molybdenum oxides. The molybdenum oxides initially form on the external electrical leads. The oxidation then progresses to the molybdenum foil and causes a significant amount of stress on the press seal. The stress is evident from Newton rings which appear at the point at which the leads are welded to the molybdenum foil. Eventually, the quartz press seal cracks, thereby causing the lamp to fail.

Various techniques have been utilized to limit molybdenum oxidation. One technique involves the deposition of a low melting glass frit at the end of the press seal where the electrical leads enter the press seal. The frit is intended to melt when the lamp is operating, thereby preventing oxidation from moving up the lead to the press seal. Occasionally, the frit melts and runs into the lamp socket, thereby causing additional problems. A high temperature melting glass frit has also been utilized. Neither frit is well suited for production and only slows the process of oxidation without stopping it.

In another prior technique, chromium is deposited on the molybdenum in a very high temperature pack cementation process. This is a very dangerous and inconvenient process. Pure hydrogen is passed through a tube furnace at 1200° C. to initiate a reaction. The yield is very low, and devices are often damaged.

Various thin film coatings have been tried on the molybdenum with very little success. A major reason for the lack of success is that a coating of almost any thickness on the molybdenum foil causes added stress to the press seal and almost always leaves a path for oxidation to occur. Most coatings cannot withstand the temperatures encountered during fabrication of the quartz press seal. Many coatings melt or become uneven during operation and leave areas of exposed molybdenum which can become oxidized. Coatings can be used on the external electrical leads, since these leads do not form a hermetic seal with the quartz.

It is a general object of the present invention to provide improved quartz lamp assemblies.

It is another object of the present invention to provide quartz lamp assemblies having reliable, long-life press seals.

It is a further object of the present invention to provide quartz lamp assemblies with feedthrough components having oxidation-resistant surfaces.

It is still another object of the present invention to provide quartz lamp assemblies having oxidation-resistant molybdenum feedthrough foils.

It is yet another object of the present invention to provide quartz lamp assemblies with external molybdenum electrical leads having oxidation-resistant surfaces.

SUMMARY OF THE INVENTION

According to the present invention, these and other objects and advantages are achieved in a lamp assembly comprising a quartz lamp envelope that encloses a sealed lamp interior, the lamp envelope including a press seal, and at least one molybdenum foil electrical feedthrough extending through the press seal to the lamp interior. The molybdenum foil has an oxidation-inhibiting material embedded in a surface layer thereof.

Preferably the oxidation-inhibiting material is applied to the molybdenum foil feedthrough by ion implantation. The oxidation-inhibiting material can be selected from the group consisting of chromium, aluminum, silicon, titanium, tantalum, palladium and combinations of these elements. Preferred materials include chromium and aluminum. The thickness of the surface layer is typically in the range of about 20 to 100 angstroms.

The lamp assembly typically includes an external molybdenum electrical lead connected to the molybdenum foil. In accordance with another aspect of the invention, the electrical lead has an oxidation inhibiting coating thereon. The oxidation-inhibiting coating is preferably formed by plasma-enhanced chemical vapor deposition. Preferred materials include silicon carbide, silicon nitride and combinations thereof. Since the molybdenum electrical lead does not extend into the press seal, the added thickness is not detrimental to seal integrity.

According to yet another aspect of the present invention, the electrical lead has an oxidation-inhibiting material embedded into a surface layer thereof. The surface layer can be formed by ion implantation of the materials identified above in connection with the treatment of the molybdenum foil feedthrough.

According to yet another aspect of the invention, a method for making a lamp assembly comprises the steps of ion implanting an oxidation-inhibiting material into a surface layer of a molybdenum foil strip, and sealing the molybdenum foil strip into a press seal of a quartz lamp envelope to form an electrical feedthrough to a sealed lamp interior. The method preferably includes the additional steps of forming an oxidation-inhibiting coating on an external electrical lead by plasma-enhanced chemical vapor deposition and attaching the coated electrical lead to the molybdenum foil strip.

BRIEF DESCRIPTION OF THE DRAWINGS

For a better understanding of the present invention, together with other and further objects, advantages and capabilities thereof, reference is made to the accompanying drawings which are incorporated herein by reference and in which.

DETAILED DESCRIPTION OF THE INVENTION

Figure 1:
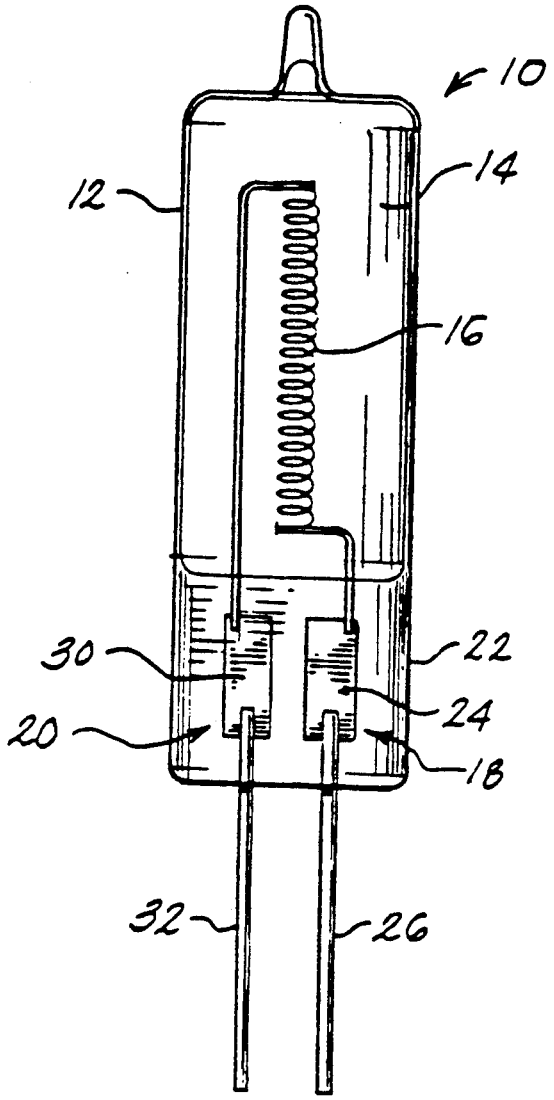
FIG. 1 is an elevational view of a tungsten halogen incandescent lamp utilizing a quartz lamp envelope and molybdenum foil for electrical feedthroughs.

A quartz lamp assembly in accordance with the present invention is shown in FIG. 1. A lamp assembly 10 includes a quartz lamp envelope 12 which encloses a sealed lamp interior 14. An incandescent filament 16 is mounted within the lamp interior 14 and is connected to electrical feedthroughs 18 and 20 which extend through a press seal region 22 of the lamp envelope 12 for connection to an external source of electrical energy. The feedthrough 18 includes a molybdenum ribbon, or foil, 24 and a molybdenum electrical lead 26. The feedthrough 20 includes a molybdenum foil 30 and a molybdenum electrical lead 32. The electrical leads 26 and 32 are typically welded to molybdenum foils 24 and 30, respectively. Opposite ends of filament 16 are electrically connected to foils 24 and 30. The quartz of the lamp envelope 12 is sealed to foils 24 and 30 using a conventional press seal process so that the lamp interior 14 is isolated from the external environment.

Figure 2:
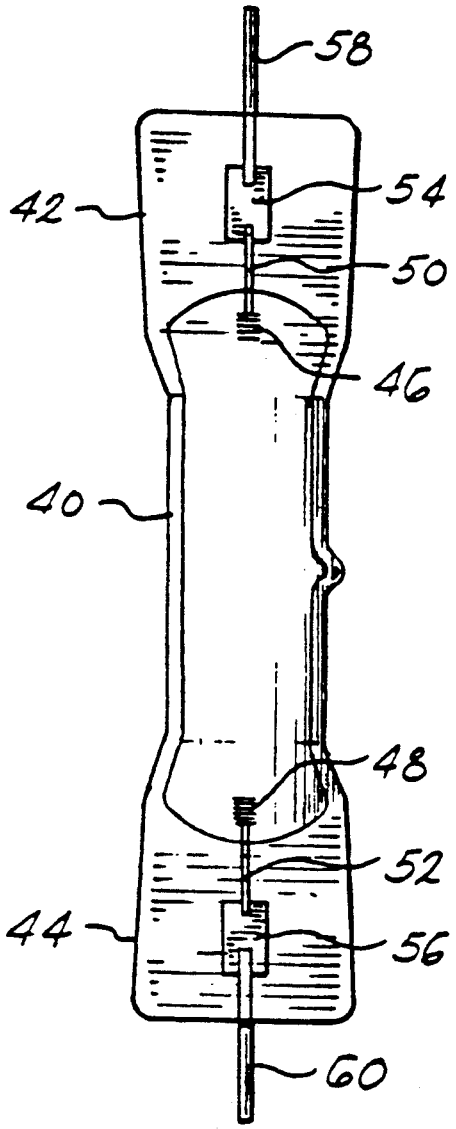
FIG. 2 is an elevational view of a metal halide arc discharge lamp utilizing molybdenum foil electrical feedthroughs.

A metal halide discharge lamp utilizing a quartz lamp envelope is shown in FIG. 2. A generally cylindrical quartz lamp envelope 40 includes press seals 42 and 44 at opposite ends thereof. Discharge electrodes 46 and 48 are coupled by electrode rods 50 and 52 to molybdenum foils 54 and 56, respectively. Molybdenum electrical leads 58 and 60, which are coupled to molybdenum foils 54 and 56, respectively, provide means for connection of the electrodes to an external electrical source. The molybdenum foils 54 and 56 are located in press seals 42 and 44, respectively.

It will be understood that quartz lamp assemblies can have various sizes, shapes and electrode or filament configurations. However, a common feature is a press or pinch seal with a molybdenum foil which acts as an electrical feedthrough. The width of the molybdenum foil is selected to carry the lamp operating current; and the thickness of the molybdenum foil is typically about 0.013 inch.

An oxidation inhibiting material is preferably embedded in a surface layer of molybdenum foils 24, 30, 54, 56. The oxidation inhibiting material is embedded in the surface of the molydenum rather than forming a separate coating layer. Therefore, the oxidation-inhibiting material does not increase the thickness of the molybdenum foils. As noted hereinabove, an increase in thickness is detrimental to seal integrity since it increases the probability of cracking caused by differential thermal expansion.

Preferably, the oxidation-inhibiting material is embedded in the surface layer of the molybdenum foils by ion implantation. Ion implantation is a well-known technique for introducing impurities into a bulk material such as a semiconductor or a metal. A beam of ions is generated in a source and is directed with varying degrees of acceleration toward the target. The momentum of the ions causes them to be embedded in the material of the target. The depth of penetration depends on the energy of the ions. An important advantage of ion implantation is that the ions of the oxidation inhibiting material penetrate into the bulk of the molybdenum and do not increase its thickness.

Suitable oxidation-inhibiting materials include chromium, aluminum, silicon, titanium, tantalum, palladium and combinations of those metals. Preferred materials include chromium, aluminum and combinations thereof. Preferably, the surface layer in which the oxidation-inhibiting material is embedded has a thickness in the range of about 20 to 100 angstroms. The ion energy during implantation is selected to achieve the desired surface layer thickness. In an example of the ion implantation procedure, chromium ions are embedded into the molybdenum foil at an energy of 50 KeV and a dose of $1\times10^{17}/cm^2$. Quartz press seals with molybdenum ribbons treated with chromium and aluminum have remained unchanged for over 100 hours at 650° C., while untreated control foils failed at an average of 5 to 10 hours. A press seal is considered to have failed when a crack forms through the seal.

The molybdenum electrical leads 26, 32, 58, 60 that are attached to the external ends of the molybdenum foils can be provided with an oxidation-inhibiting surface layer using ion implantation in the same manner described hereinabove in connection with the molybdenum foils. It is important to provide oxidation-resistant surfaces on the electrical leads 26, 32, 58 and 60 even though the leads are outside the press seal, since oxidation progresses along the leads to the press seal, thereby causing seal failure.

In providing an oxidation-inhibiting surface on the electrical leads 26, 32, 58, 60, it is not necessary to maintain a constant dimension since the electrical leads are outside the seal region. In accordance with a further important aspect of the invention, an oxidation-inhibiting coating is applied to the molybdenum electrical leads by plasma-enhanced chemical vapor deposition (PECVD). PECVD is a known process in which a coating is deposited on the surface of a substrate by means of a plasma. The thickness of the coating is determined by the deposition time, and the composition is determined by the plasma composition. One advantage of the PECVD process is that the coating is uniformly applied to the surface of the electrical leads.

Suitable materials for PECVD coating of molybdenum electrical leads include silicon carbide and silicon nitride. Preferably, the oxidation-inhibiting coating has a thickness in the range of about 50 to 1000 angstroms. The preferred coating is silicon carbide. Silicon carbide coating of components by PECVD can be obtained from Spire Corporation of Bedford, Mass. Molybdenum samples coated with silicon carbide have withstood temperatures up to 700° C. in air for over 150 hours without any change, while untreated control samples of molybdenum last for only one hour under the same conditions before oxidizing.

In a preferred embodiment of the lamp assembly, the quartz lamp envelope is fabricated with molybdenum foils that are ion implanted with chromium, aluminum or combinations thereof to a depth of 20 to 100 angstroms. The molybdenum electrical leads have a coating of silicon carbide deposited by PECVD. This combination provides very high resistance to oxidation and does not require changes in the lamp production process. The oxidation inhibiting materials are applied to the foils and to the electrical leads prior to the lamp assembly process. Oxidation of the molybdenum lamp components is significantly reduced, thereby allowing the lamp to have a much longer life with considerably fewer failures caused by molybdenum oxidation.

While there has been shown and described what is at present considered the preferred embodiments of the present invention, it will be obvious to those skilled in the art that various changes and modifications may be made therein without departing from the scope of the invention as defined by the appended claims.

What is claimed is:

1. A lamp assembly comprising:

a quartz lamp envelope that encloses a sealed lamp interior, said lamp envelope including a press seal;

at least one treated molybdenum foil electrical feedthrough extending through said press seal to said lamp interior, said treated molybdenum foil having an oxidation-inhibiting material embedded in a surface layer thereof by means of an ion implantation process, the thickness of said treated molybdenum foil being no greater than the thickness of said molybdenum foil before being so treated.

2. A lamp assembly as defined in claim 1 wherein said oxidation-inhibiting material is selected from the group consisting of chromium, aluminum, silicon, titanium, tantalum, palladium and combinations thereof.

3. A lamp assembly as defined in claim 1 wherein said oxidation-inhibiting material comprises chromium.

4. A lamp assembly as defined in claim 1 wherein said oxidation inhibiting material comprises aluminum.

5. A lamp assembly as defined in claim 1 wherein said surface layer has a thickness in the range of about 20 to 100 angstroms.

6. A lamp assembly as defined in claim 1 further including an incandescent filament located in said lamp interior and coupled to said molybdenum foil.

7. A lamp assembly as defined in claim 1 further including a discharge electrode located in said lamp interior and coupled to said molybdenum foil.

8. A lamp assembly as defined in claim 1 further including a molybdenum electrical lead connected to said molybdenum foil, said electrical lead having an oxidation-inhibiting material embedded in a surface layer thereof.

9. A lamp assembly as defined in claim 8 wherein said oxidation-inhibiting material is embedded in the surface layer of said electrical lead by ion implantation.

10. A lamp assembly as defined in claim 2 further including a molybdenum electrical lead connected to said molybdenum foil, said electrical lead having an oxidation-inhibiting coating thereon.

11. A lamp assembly as defined in claim 10 wherein said oxidation-inhibiting coating is selected from the group consisting of silicon carbide, silicon nitride and combinations thereof.

12. A lamp assembly as defined in claim 10 wherein said oxidation-inhibiting coating comprises silicon carbide.

13. A lamp assembly as defined in claim 11 wherein said oxidation-inhibiting coating is applied to said electrical lead by plasma-enhanced chemical vapor deposition.

14. A lamp assembly as defined in claim 10 wherein said oxidation inhibiting coating has a thickness in the range of about 50 to 1000 angstroms.

15. A lamp assembly comprising:

a quartz lamp envelope that encloses a sealed lamp interior, said lamp envelope including a press seal; and at least one treated conductive foil electrical feedthrough extending through said press seal to said lamp interior, said treated conductive foil having an oxidation-inhibiting material embedded in a surface layer thereof by means of an ion implantation process, the thickness of said treated molybdenum foil being no greater than the thickness of said molybdenum foil before being so treated.

16. A lamp assembly as defined in claim 15 wherein said oxidation-inhibiting material is selected from the group consisting of chromium, aluminum, silicon, titanium, tantalum, palladium and combinations thereof.

17. A lamp assembly as defined in claim 15 further including an external electrical lead connected to said conductive foil, said electrical lead having an oxidation-inhibiting coating thereon.

18. A lamp assembly as defined in claim 17 wherein said oxidation-inhibiting coating is applied to said electrical lead by plasma-enhanced chemical vapor deposition.

19. A lamp assembly as defined in claim 18 wherein said oxidation-inhibiting coating is selected from the group consisting of silicon carbide, silicon nitride and combinations thereof.

20. A lamp assembly as defined in claim 15 wherein said conductive foil comprises molybdenum.

21. A method of making a lamp assembly comprising the steps of:

ion implanting an oxidation-inhibiting material into a surface layer of a molybdenum foil strip; and sealing the molybdenum foil strip into a press seal of a quartz lamp envelope to form an electrical feedthrough to a sealed lamp interior.

22. A method of making a lamp assembly as defined in claim 21 wherein the step of ion implanting includes the step of ion implanting a material selected from the group consisting of chromium, aluminum and mixtures thereof into the surface layer of said molybdenum foil strip.

23. A method of making a lamp assembly as defined in claim 21 further including the steps of forming an oxidation inhibiting coating on an external electrical lead by plasma-enhanced chemical vapor deposition, and attaching the coated electrical lead to said molybdenum foil strip.

24. A method of making a lamp assembly as defined in claim 21 further including the steps of ion implanting an oxidation-inhibiting material into a surface layer of an external electrical lead, and attaching the electrical lead to said molybdenum foil strip.

* * * * *